US010894266B2

(12) United States Patent
Fields et al.

(10) Patent No.: US 10,894,266 B2
(45) Date of Patent: Jan. 19, 2021

(54) PUMP DISPENSER HEAD WITH INCREASED UNLOCKING TORQUE

(71) Applicant: Silgan Dispensing Systems Corporation, Grandview, MO (US)

(72) Inventors: Bryan K. Fields, Overland Park, KS (US); Alejandro Espinoza, Overland Park, KS (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 9 days.

(21) Appl. No.: 16/326,561

(22) PCT Filed: Aug. 22, 2017

(86) PCT No.: PCT/US2017/047888
§ 371 (c)(1),
(2) Date: Feb. 19, 2019

(87) PCT Pub. No.: WO2018/039154
PCT Pub. Date: Mar. 1, 2018

(65) Prior Publication Data

US 2019/0210050 A1 Jul. 11, 2019

Related U.S. Application Data

(60) Provisional application No. 62/378,399, filed on Aug. 23, 2016.

(51) Int. Cl.
*B05B 11/00* (2006.01)
*A47K 5/12* (2006.01)

(52) U.S. Cl.
CPC ..... *B05B 11/3001* (2013.01); *A47K 5/12* (2013.01); *B05B 11/306* (2013.01); *B05B 11/0089* (2013.01); *B05B 11/3047* (2013.01)

(58) Field of Classification Search
CPC ..... A47K 5/12; A47K 5/1201; B05B 11/306; B05B 11/3001; B05B 11/3059;
(Continued)

(56) References Cited

U.S. PATENT DOCUMENTS 5,738,250 A * 4/1998 Gillingham ..... B05B 11/3001 222/153.13
7,568,598 B2 * 8/2009 Ophardt ..... A47K 5/1202 222/518

(Continued)

OTHER PUBLICATIONS

PLUS Results, Generated internally by USPTO's "STIC" team, from a Request generated internally by Andrew Bainbridge on Aug. 21, 2020 (Year: 2020).*

(Continued)

*Primary Examiner* — Paul R Durand
*Assistant Examiner* — Andrew P Bainbridge
(74) *Attorney, Agent, or Firm* — Barlow, Josephs & Holmes, Ltd.

(57) ABSTRACT

A pump dispenser head has a lockdown feature to prevent unintended dispensing during shipment. Releasing the lockdown feature requires increased torque compared with typical dispensers, allowing the dispenser to be shipped with less packaging while still preventing leakage of the contents.

11 Claims, 6 Drawing Sheets

(58) Field of Classification Search
CPC ..... B05B 11/0089; B05B 11/3047; B05B 11/3025; B67B 7/00
USPC ..... 222/153.13–153.14, 153.04
See application file for complete search history.

(56) References Cited

U.S. PATENT DOCUMENTS

| | | | | |
|---|---|---|---|---|
| 9,908,132 | B2 * | 3/2018 | Dalisay | B05B 11/3052 |
| 10,010,897 | B2 * | 7/2018 | Espinoza | B05B 11/306 |
| 2014/0151404 | A1 * | 6/2014 | Lehmkuhl | B65D 41/0471 222/153.14 |
| 2015/0136810 | A1 * | 5/2015 | Ding | B05B 11/305 222/321.9 |
| 2017/0128966 | A1 * | 5/2017 | Law | B05B 11/0027 |
| 2019/0210050 | A1 * | 7/2019 | Fields | A47K 5/12 |

OTHER PUBLICATIONS

STIC Results, Generated internally by the USPTO's "STIC"Team, from a Request generated internally by Andrew Bainbridge on Aug. 21, 2020 (Year: 2020).*

* cited by examiner

PUMP DISPENSER HEAD WITH INCREASED UNLOCKING TORQUE

BACKGROUND OF THE INVENTION

Field of the Invention

This invention relates to pump dispenser devices with lockdown features. Such pump dispensers often incorporate reciprocating piston-type pumps which are actuated by depressing a dispenser head so that product is dispensed through a spout on or in the head. When the dispenser head is released, an internal spring raises the head to put it in position for another dispensing stroke. During shipment, the head is often locked into a fixed position to prevent reciprocation and thus avoid product leakage. In certain designs, the locking feature involves rotating the dispenser head back (or forth) through a small angle (e.g. less than 90 degrees) in order to bring the head into a locked position with no axial movement, or an unlocked position where axial movement (and thus product dispensing) is possible.

Description of Related Art

Pump dispensers are used for many household products, for example hand soaps and lotions. When shipped to a retailer, pump dispensers are usually shipped as multiple units (e.g. a dozen or more) housed in rugged packages (e.g. corrugated cartons) with little chance that the locking features will become loosened by contact with the exterior package. On the other hand, as consumers increasingly purchase such dispenser as individual units (so-called 'e-commerce' or Internet purchases) the dispenser may be housed in less rugged packages and movement may occur which can loosen and open the locking feature, leading to product leakage. Therefore, improved dispensers are sought which will overcome the challenges of e-commerce shipment.

SUMMARY OF THE INVENTION

In one embodiment of the invention, there is provided a dispenser head assembly with an increased unlocking torque to help prevent leakage of product during e-commerce shipments. In certain embodiments either flexible or rigid retention ribs may be provided between a dispenser head and an adjacent component to increase the torque required to unlock the dispenser head. In some embodiments, the dispenser may incorporate additional features to minimize the likelihood that the dispenser assembly will come loose from a product container when the increased unlocking torque is applied to the dispenser head.

In one embodiment, a dispenser assembly may include a dispenser head that may include a fluid inlet; a fluid outlet; a depending skirt; a locking rib on an inner surface of the depending skirt; and a chaplet. The chaplet may include a top wall; a skirt extending downward from the top wall; and a locking ramp with a proximal end attached to the top wall, and a distal end extending above the top wall and free to flex with respect to the top wall. The dispenser head may be is rotatable relative to the chaplet between a lock-down position and an unlocked position, wherein placing the dispenser head in the lock-down position requires a first torque to rotate the dispenser head and move the locking rib past the locking ramp, and returning the dispenser header to an unlocked position requires a second torque greater than the first torque.

This and other embodiments of the present invention will become readily apparent to those skilled in the art from the following detailed description of various embodiments having reference to the attached figures, the invention not being limited to any particular embodiment(s) disclosed.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

DETAILED DESCRIPTION

Figure 1:
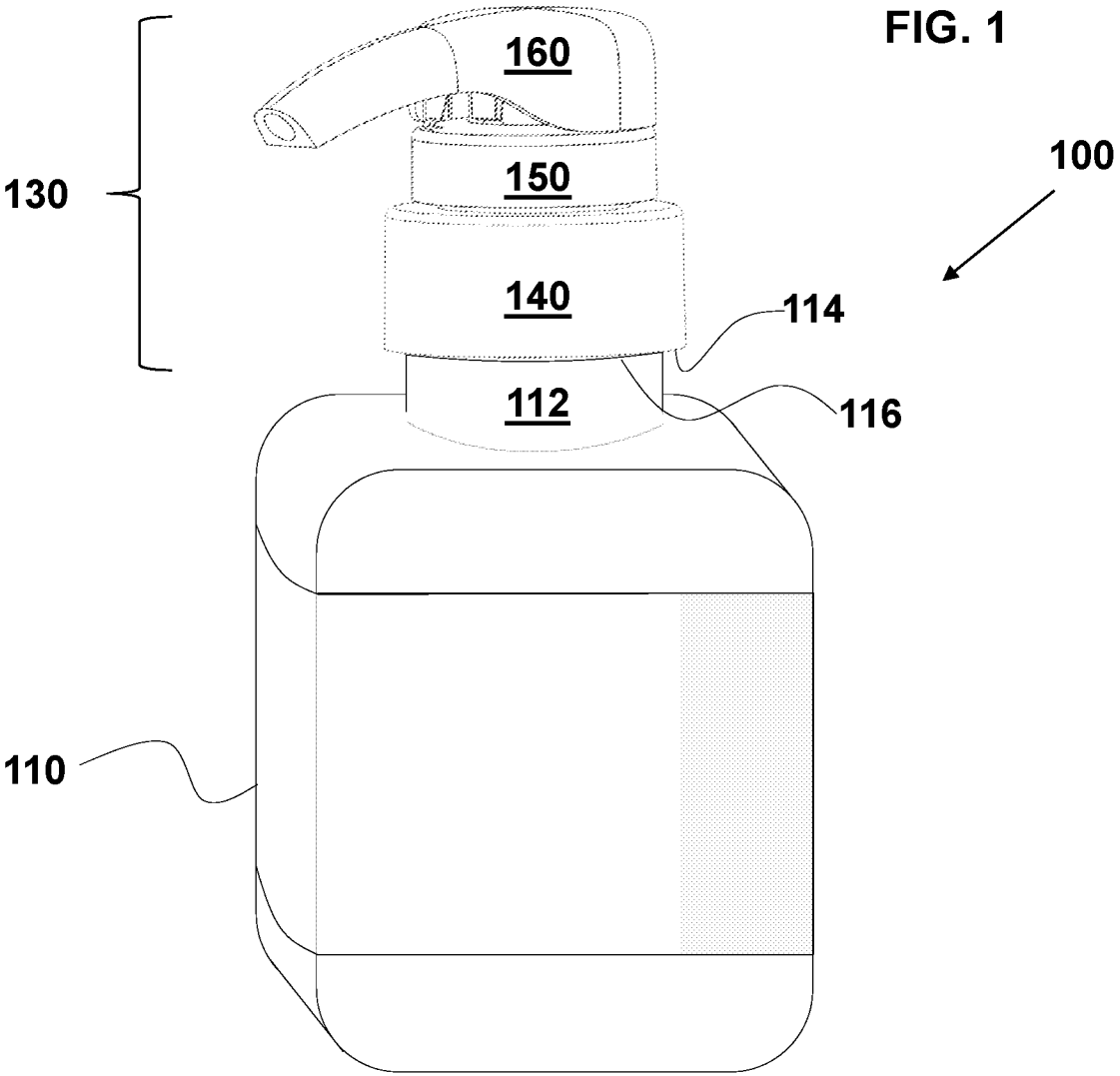
FIG. 1 illustrates a perspective view of a pump dispenser attached to a product container.

FIG. 1 illustrates a perspective view of a pump dispenser 100 including a dispenser assembly 130 attached to a product container 110. Dispenser assembly 130 may include a dispenser head 160, chaplet 150, and a closure 140. The attachment of dispenser assembly 130 to container 110 may be achieved by the use of a closure 140 attached to the neck 112 of container 110. Neck 112 may have threads 114 (not shown) formed thereon for attaching to closure 140. Neck 112 may also have anti-backoff elements such as ratchet teeth 116 (not shown) to help prevent loosening of closure 140.

Figures 2A, 2B:
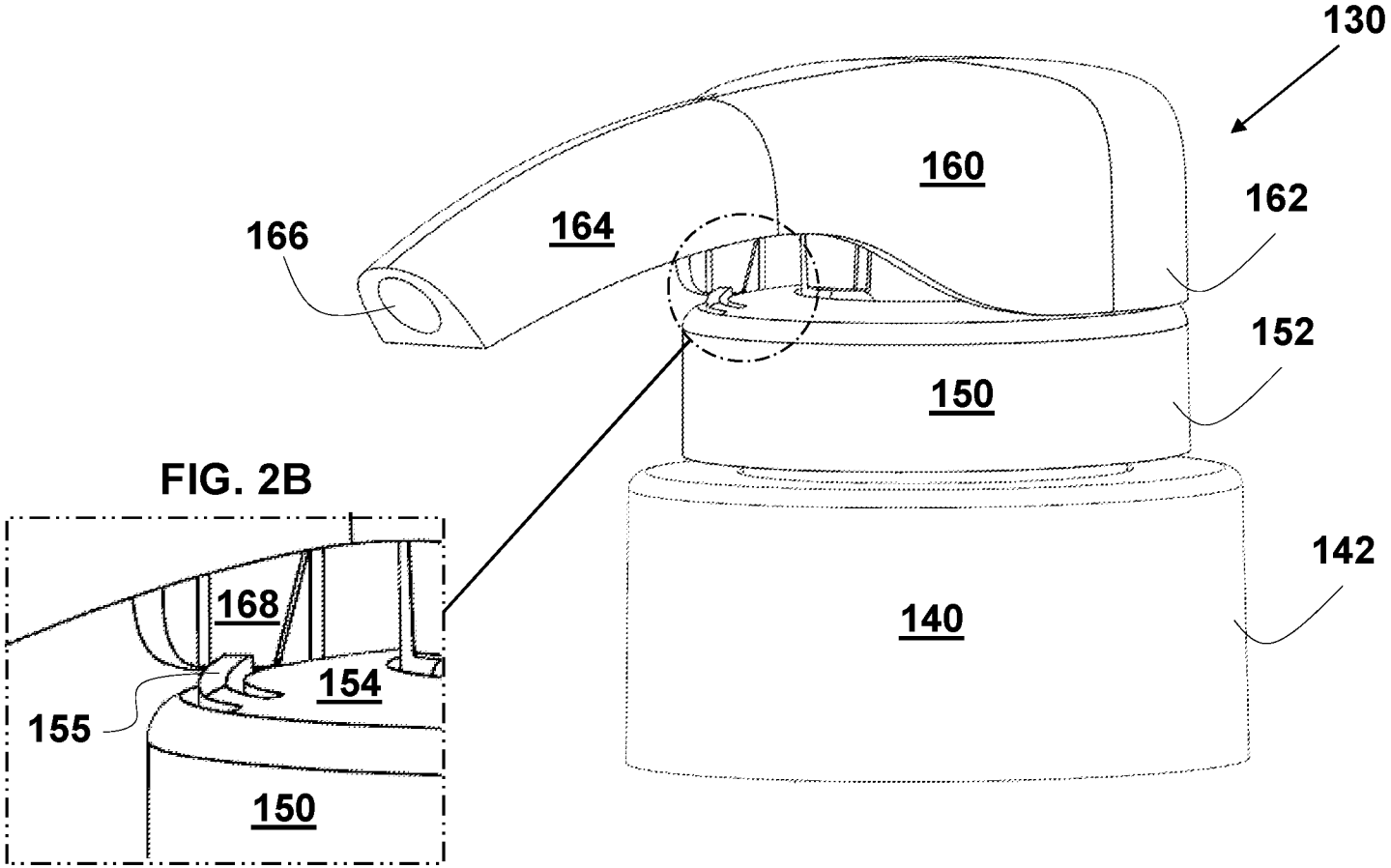
FIG. 2A illustrates a perspective view of a dispenser assembly.
FIG. 2B illustrates a detail of interference features to increase the torque required to unlock a dispenser head.

FIG. 2A illustrates a perspective view of dispenser assembly 130, with certain elements identified. Closure 140 may include a cylindrical outer wall or closure skirt 142. Closure skirt 142 may extend entirely around the circumference of closure 140. Likewise, chaplet 150 may include a cylindrical outer wall or chaplet skirt 152 that may extend entirely around the circumference of chaplet 150. Dispenser head 160 may include a peripheral outer wall or skirt 162 that may extend partially (as shown) or entirely around dispenser head 160. Extending from dispenser head 160 may be provided a spout 164 with a product outlet 166 formed therein. Spout 164 may be longer or shorter than illustrated.

FIG. 2B illustrates a detail of interference features to increase the torque required to unlock dispenser head 160. One or more ramps 155 may be provided on top wall 154 of chaplet 150. One or more ribs 168 may be provided on dispenser head 160, for example extending inward from skirt 162. Ribs 168 may engage ramps 155 to prevent rotation of dispenser head 160 until a certain unlocking torque is applied to dispenser head 160. For example, ramp 155 may increase in height in a clockwise direction (as shown in FIG. 2B) so that as dispenser head 160 is rotated in a clockwise direction, rib 168 may slide along ramp 155 and then drop into a locked position just beyond the upper end of ramp 155. Ramp 155 may deflect and/or rib 168 may flex in order for the two parts to pass by one another. This may require a certain locking torque TL that is less than the torque Tu required to unlock dispenser head 160 by rotating it counter-clockwise during which rotation rib 168 may, for example, be required to flex to a greater degree in order to rise up over ramp 155 (or ramp 155 may need to be pressed downward by rib 168, in order for rib 168 to go past ramp 155 in the counter-clockwise direction).

Figure 3:
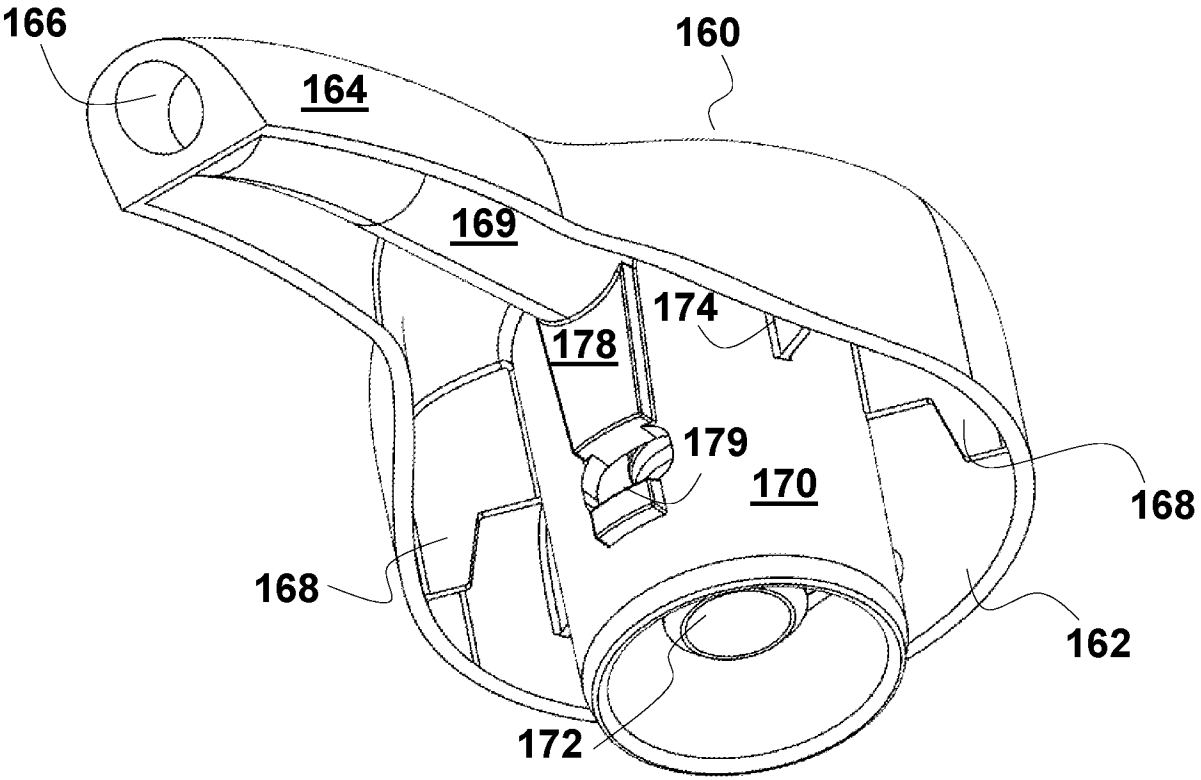
FIG. 3 illustrates a bottom perspective view of a dispenser head, showing certain interference features to increase the torque required to unlock the dispenser head.

FIG. 3 illustrates a bottom perspective view of dispenser head 160, showing certain interference features to increase the torque required to unlock dispenser head 160. Besides dispenser head skirt 162 and spout 164 already described, dispenser head 160 may include a fluid conduit 169 delivering product to product outlet 166. Dispenser head 160 may also include an outer cylinder 170 and an inner cylinder 172. Inner cylinder may be connected to a pump assembly (not shown) such as a piston/cylinder pump assembly with associated components typically used in pump dispensers. Outer cylinder 170 may provide strength to dispensing head 160 and may have formed on its outer surface one or more locking keys 178, 179 for engaging keyway(s) 159 on chaplet 150 (see FIG. 4). Located between dispenser head skirt 162 and outer cylinder 170 may be provided one or more strengthening ribs 174. Also located between dispenser head skirt 162 and outer cylinder 170 may be provided one or more locking ribs 168 to engage locking ramps 155. Locking ribs 168 may be attached to one or both of dispenser head skirt 162 and outer cylinder 170. The number, size, shape, and thickness of locking ribs 168, and the degree to which they are attached to one or both of dispenser head skirt 162 and outer cylinder 170, along with certain qualities of the locking ramps 155, may determine the torque Tu required to unlock dispenser head 160.

Figure 4:
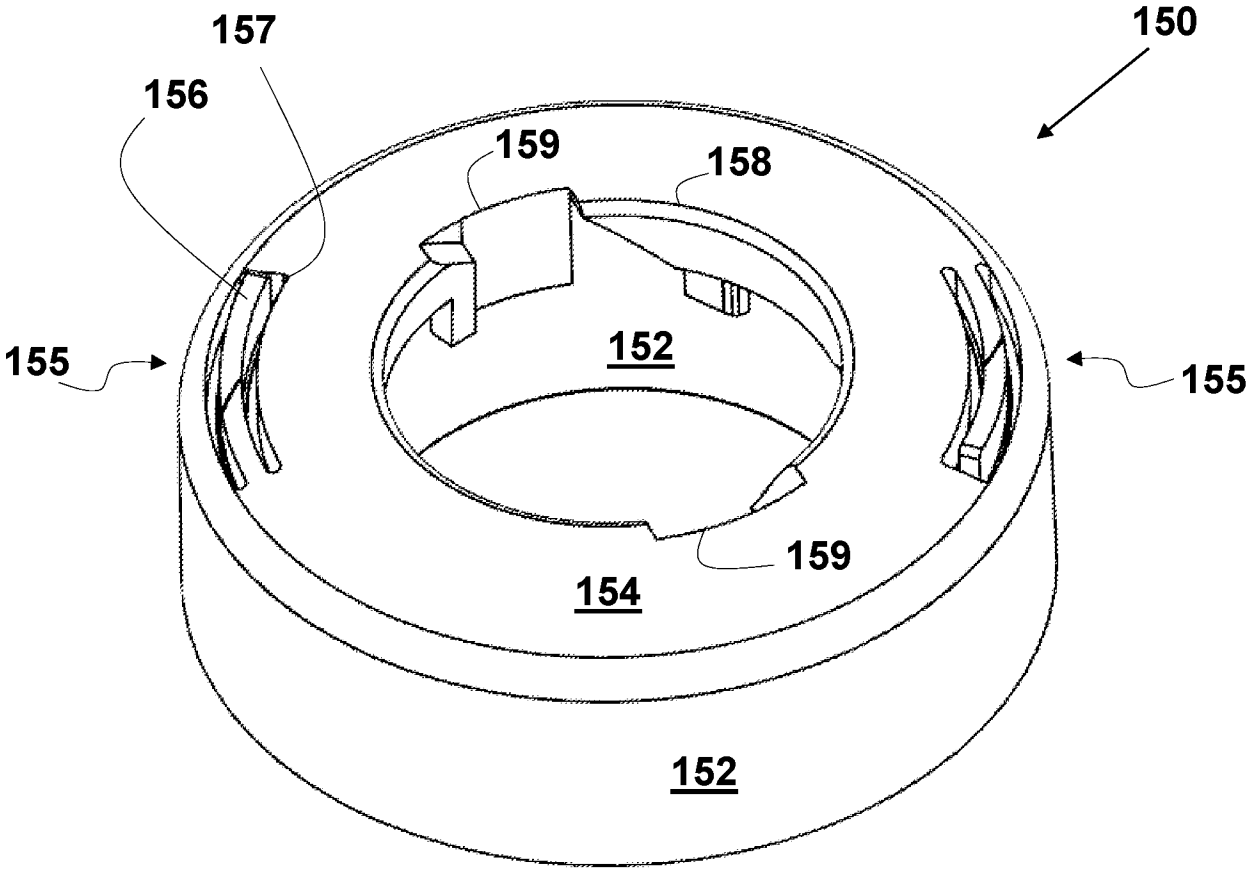
FIG. 4 illustrates a top perspective view of a chaplet to fit between a dispenser head and a closure collar, the chaplet including certain interference features to increase the torque required to unlock the dispenser head.

FIG. 4 illustrates a top perspective view of a chaplet 150 to fit between dispenser head 160 and closure 140, with chaplet 150 including ramps 155 to increase torque Tu required to unlock dispenser head 160. In this example, ramps 155 may be flexible, for example by the distal end of ramp body 156 being separated from chaplet top wall 154 by cuts or slots 157. This may allow ramps 155 to flex downward during locking rotation so that the clockwise locking torque TL is less than the counter-clockwise unlocking torque Tu. The dimensions of ramps 155 may help determine the amount of torque required to unlock (or lock) dispenser head 160. As the locking ribs 168 move clockwise along ramps 155, ramps 155 may flex downward so that their upper surface is level with the top of chaplet 150.

Also shown in FIG. 4 is chaplet opening 158 with one or more keyways 159 to receive locking keys 178, 179. Once dispenser head 160 is unlocked by freeing locking ribs 168 from locking ramps 155, keyways 159 may allow dispenser head 160 to move vertically into a position from which product dispensing may occur.

Figure 5:
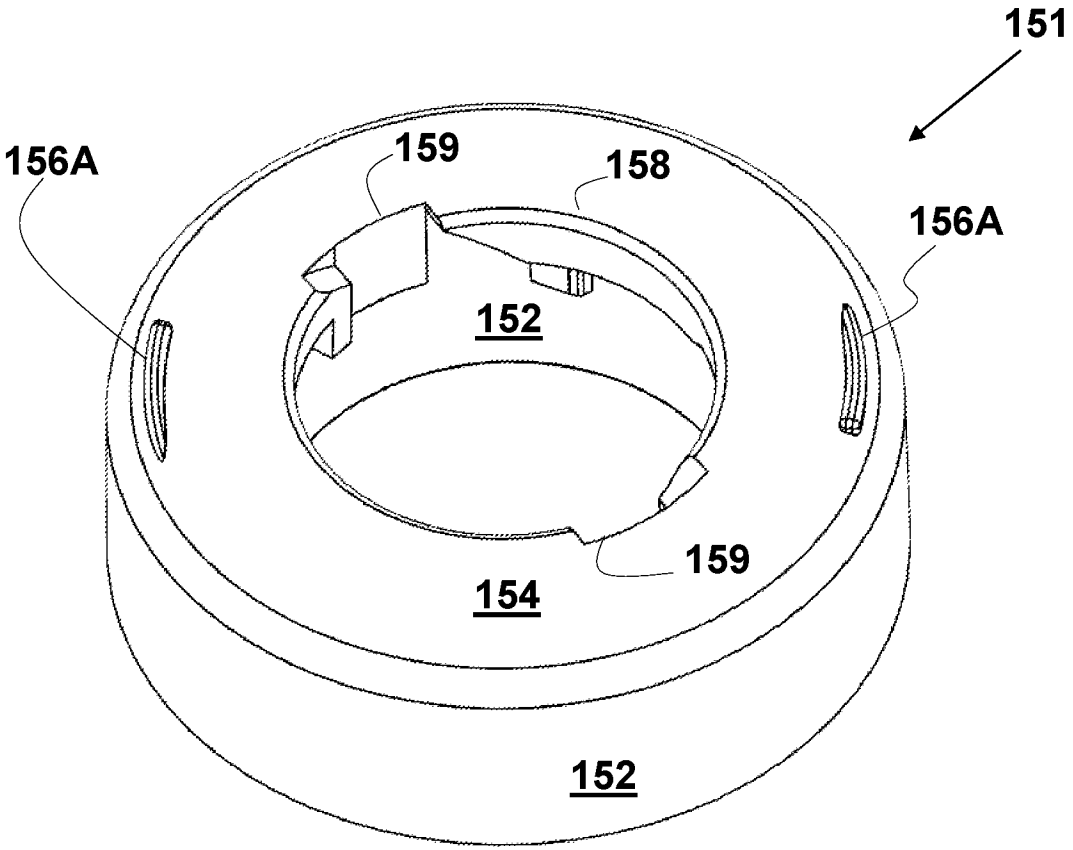
FIG. 5 illustrates a top perspective view of a chaplet including certain alternative interference features to increase the torque required to unlock a dispenser head.

FIG. 5 illustrates a top perspective view of a slightly different chaplet 151 to fit between dispenser head 160 and closure 140, with chaplet 151 including ramps 156A to increase the torque Tu required to unlock dispenser head 160. In this example, ramps 156A may be molded into chaplet top wall 154 without peripheral cuts or slots 157, and thus may flex less than ramps 155. The height of ramps 156A above chaplet top wall 154 may help determine the amount of torque required to unlock (or lock) dispenser head 160. With this design, flexibility between the locking members may be provided mainly by locking ribs 168.

Figure 6:
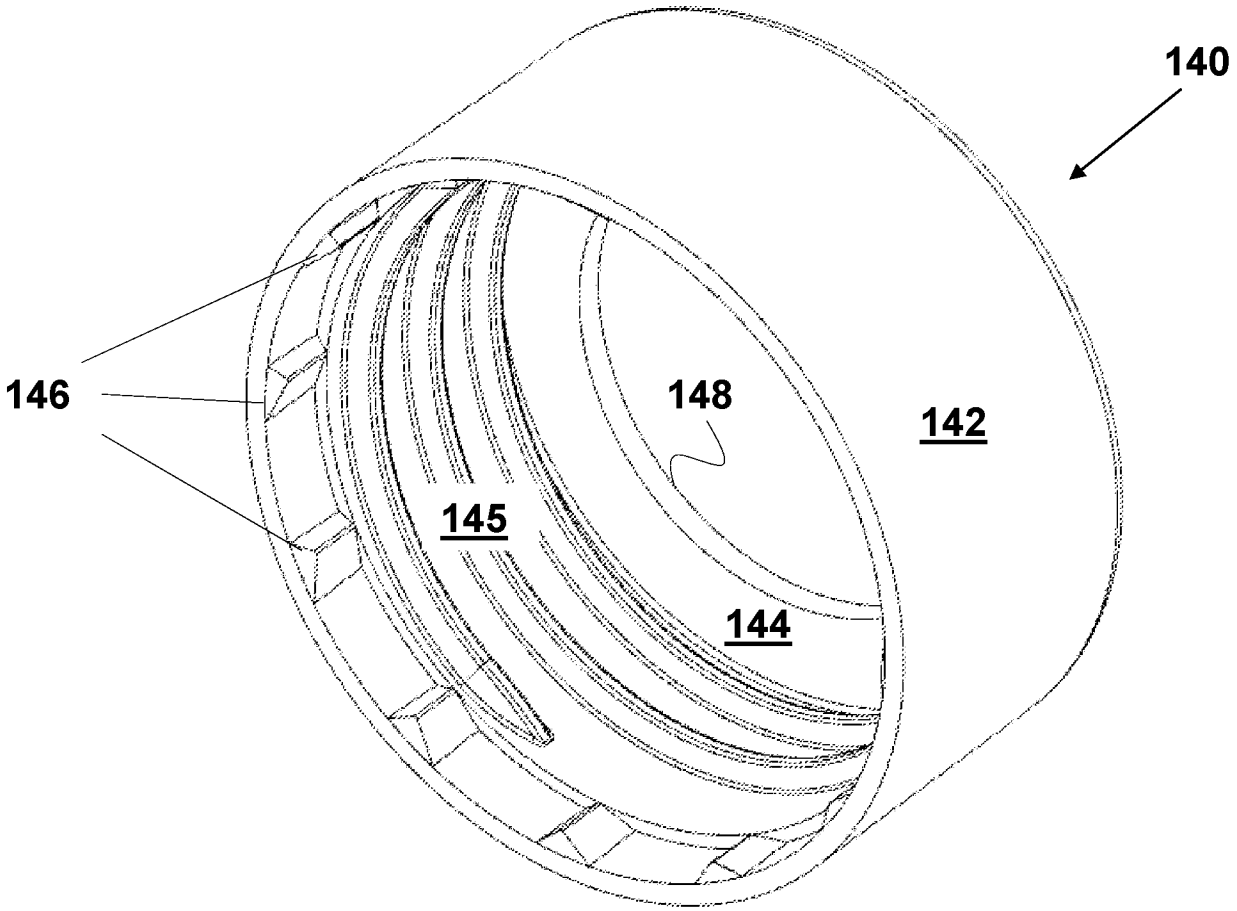
FIG. 6 illustrates a bottom perspective view of a closure collar used to attach a dispenser assembly onto a product container.

FIG. 6 illustrates a bottom perspective view of closure 140 used to attach dispenser assembly 130 onto a product container 110. Besides closure skirt 142 already described, the closure may include closure top wall 144 with its opening 148. The interior of closure skirt 142 may include closure threads 145 to mate with bottle threads 114, and anti-rotation teeth 146 to engage bottle ratchet teeth 116. The use of such anti-rotation features between closure 140 and product container 110 may be advantageous to prevent closure 140 from coming loose from container 110 when a higher unlocking torque Tu is applied to unlock the dispenser head 160.

For connecting closure 140 to product container 110, a bayonet connection, crimp connection, snap connection, adhesive connection, or other connection may be used instead of the threaded connection depicted here. Also, instead of ratchet teeth 116, 146 other methods may be used to prevent loosening dispenser assembly 130 from product container 110 when a higher than usual unlocking torque Tu is applied.

While certain embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A dispenser assembly comprising:

a dispenser head comprising a fluid inlet;

a fluid outlet;

a depending skirt; and a locking rib on an inner surface of the depending skirt; and a chaplet comprising a top wall;

a skirt extending downward from the top wall; and a locking ramp with a proximal end attached to the top wall, and a distal end extending above the top wall and free to flex with respect to the top wall;

wherein the dispenser head is rotatable relative to the chaplet between a lock-down position and an unlocked position; and wherein placing the dispenser head in the lock-down position requires a first torque to rotate the dispenser head and move the locking rib past the locking ramp, and returning the dispenser header to an unlocked position requires a second torque, and the second torque is greater than the first torque.

2. The dispenser assembly of claim 1, wherein a distal end of the locking ramp is separated from the chaplet top wall by at least one of a cut and a slot.

3. The dispenser assembly of claim 1, wherein the distal end of the locking ramp is configured to flex downward into the top wall.

4. The dispenser assembly of claim 3, wherein the ramp is configured to flex downward so that the ramp upper surface is level with the top wall.

5. The fluid dispenser of claim 1, further comprising a pump engine connected to the fluid inlet.

6. The fluid dispenser of claim 1, further comprising a container closure positioned beneath the chaplet.

7. The fluid dispenser of claim 6, further comprising a fluid container connected to the container closure.

8. The fluid dispenser of claim 1, further comprising at least one additional locking ramp.

9. The fluid dispenser of claim 8, further comprising a pump engine connected to the fluid inlet.

10. The fluid dispenser of claim 8, further comprising a container closure positioned beneath the chaplet.

11. The fluid dispenser of claim 10, further comprising a fluid container connected to the container closure.

* * * * *